United States Patent [19]

Amiel et al.

[11] Patent Number: 4,936,492

[45] Date of Patent: Jun. 26, 1990

[54] PRECOMPRESSION PUMP

[75] Inventors: Pierre Amiel, Neuilly sur Seine; Jean-Louis Bougamont; Alain Behar, both of Eu, all of France

[73] Assignee: Societe Francais d'Aerosols et de Bouchage, Friville-Escarbotin, France

[21] Appl. No.: 301,778

[22] Filed: Jan. 25, 1989

[30] Foreign Application Priority Data

Jan. 26, 1988 [FR] France ..... 88 00852

[51] Int. Cl.[5] ..... B65D 37/00

[52] U.S. Cl. ..... 222/207; 222/321; 222/385

[58] Field of Search ..... 222/321, 383, 385, 402.2, 222/207; 239/333

[56] References Cited

U.S. PATENT DOCUMENTS

| | | | |
|---|---|---|---|
| 3,104,785 | 9/1963 | Beard, Jr. | 222/402.2 X |
| 3,194,447 | 7/1965 | Brown | 222/321 |
| 3,211,346 | 10/1965 | Meshberg | 222/321 |
| 3,452,905 | 7/1969 | Micallef | 222/321 X |
| 3,502,035 | 3/1970 | Fedit et al. | 222/321 X |

FOREIGN PATENT DOCUMENTS

| | | | |
|---|---|---|---|
| 1327800 | 8/1973 | United Kingdom | 222/402.2 |

*Primary Examiner*—Kevin P. Shaver
*Attorney, Agent, or Firm*—Pennie & Edmonds

[57] ABSTRACT

A pump comprises an open-ended hollow body defining a pump chamber and an inlet orifice which communicates with a reservoir. The pump body has four side walls. A piston is mounted for reciprocal movement through a portion of the body and it extends through the upper end of the body. A ferrule is disposed above the body and defines an aperture through which the piston extends. A seal is disposed is disposed between the ferrule and the body, and the seal surround a portion of the piston. A spring is mounted in the body, and the spring actively biases the piston toward the top of the body. The body has a deformable zone which has at least a portion of one side wall which is a noncircular cross-section and is radially elastically deformable. The piston has a portion which blocks the inlet orifice when the piston is depressed a first predetermined distance. The piston has an evacuation duct having a lower duct portion extending through the periphery of the piston which puts the pump chamber in communication with ambient air when the piston is depressed a second predetermined distance sufficient for the lower duct portion to be lower than the seal, the second predetermined distance being greater then the first predetermined distance. The lower duct portion is located sufficiently high on the piston so as to delay the placing of the pump chamber into communication with ambient air by the evacuation duct until after the piston is depressed into the body the second predetermined distance which is sufficiently in excess of the first predetermined distance so as to pressurize the pump chamber and radially elastically deform the deform the deformable zone.

20 Claims, 3 Drawing Sheets

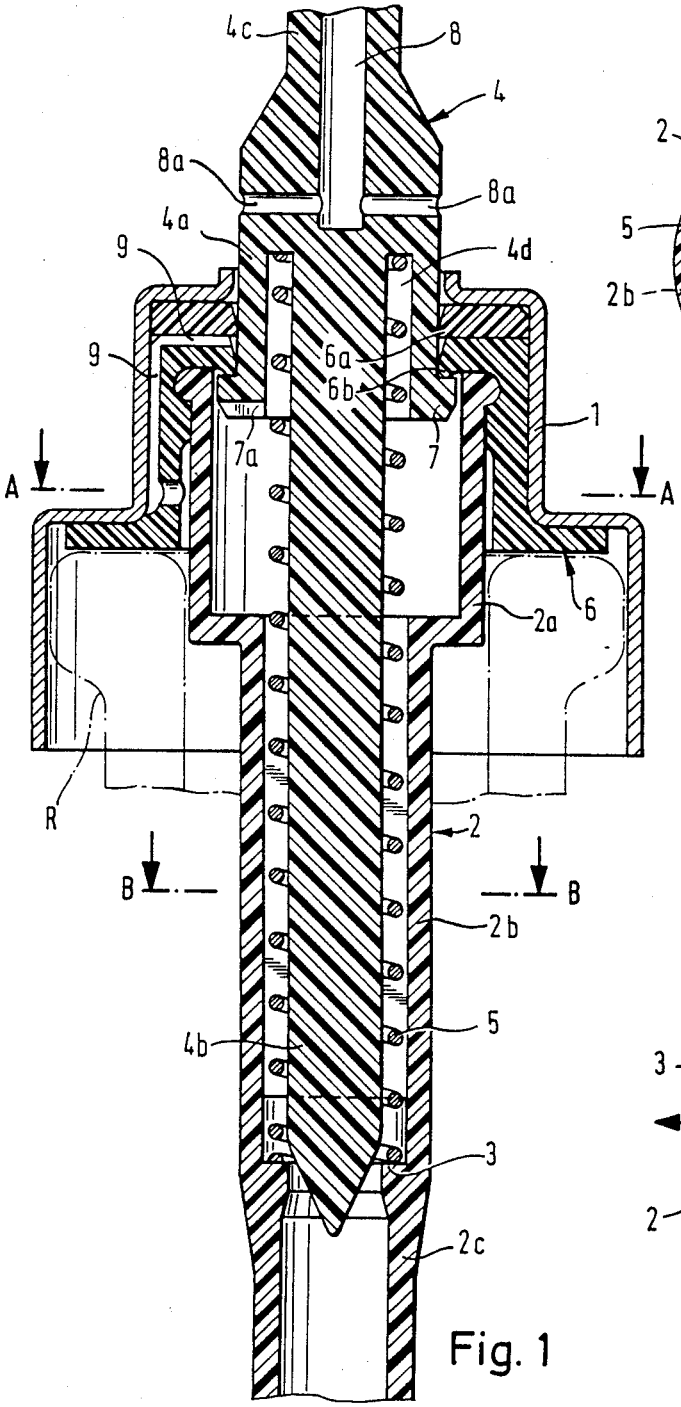
Fig. 1
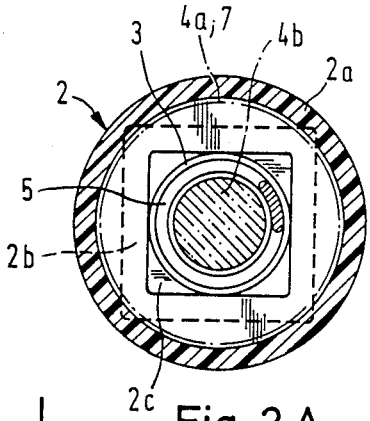
Fig. 2 A
Fig. 2 B
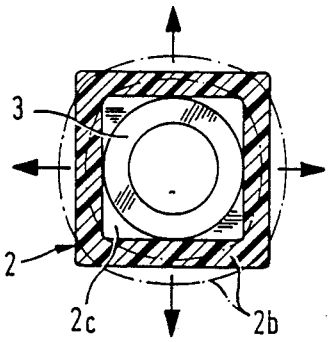

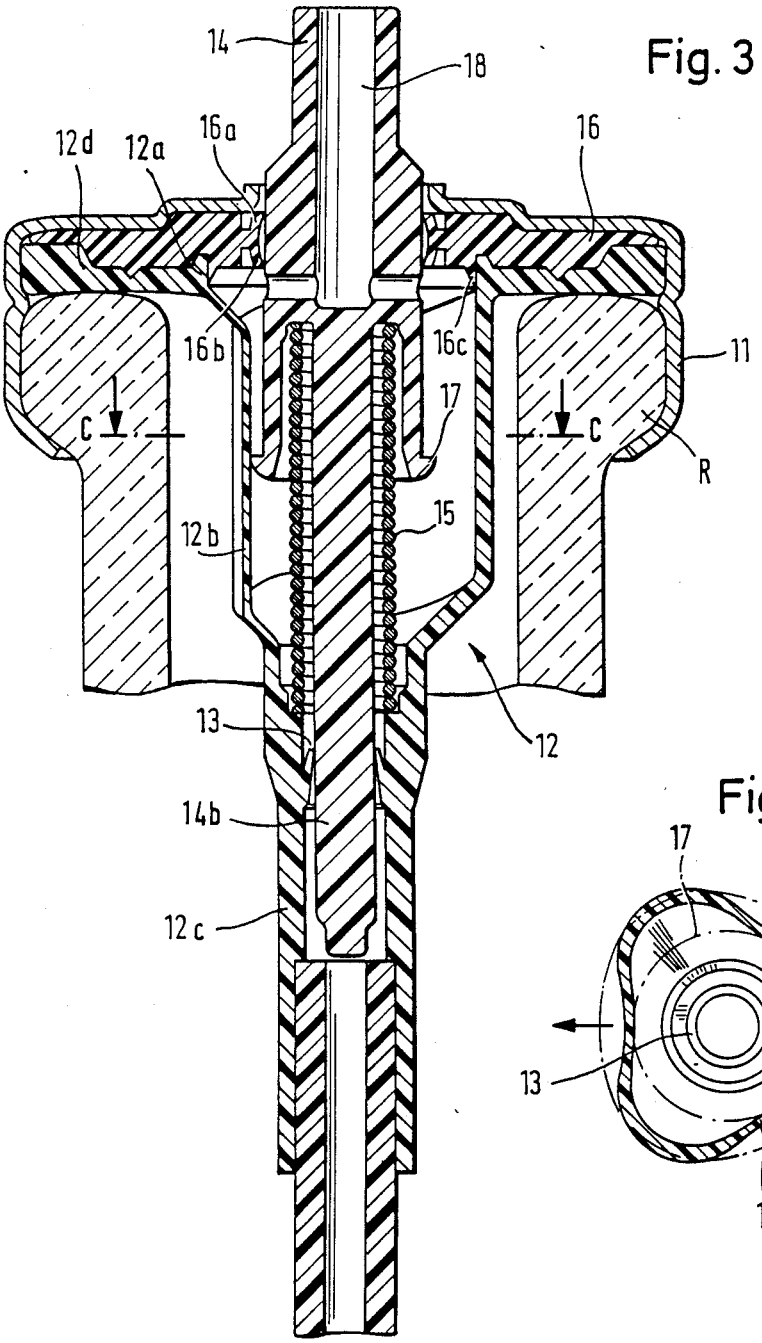
Fig. 3
Fig. 4
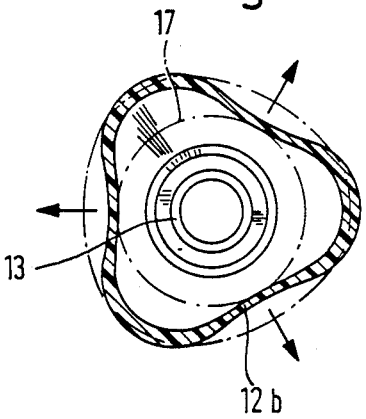

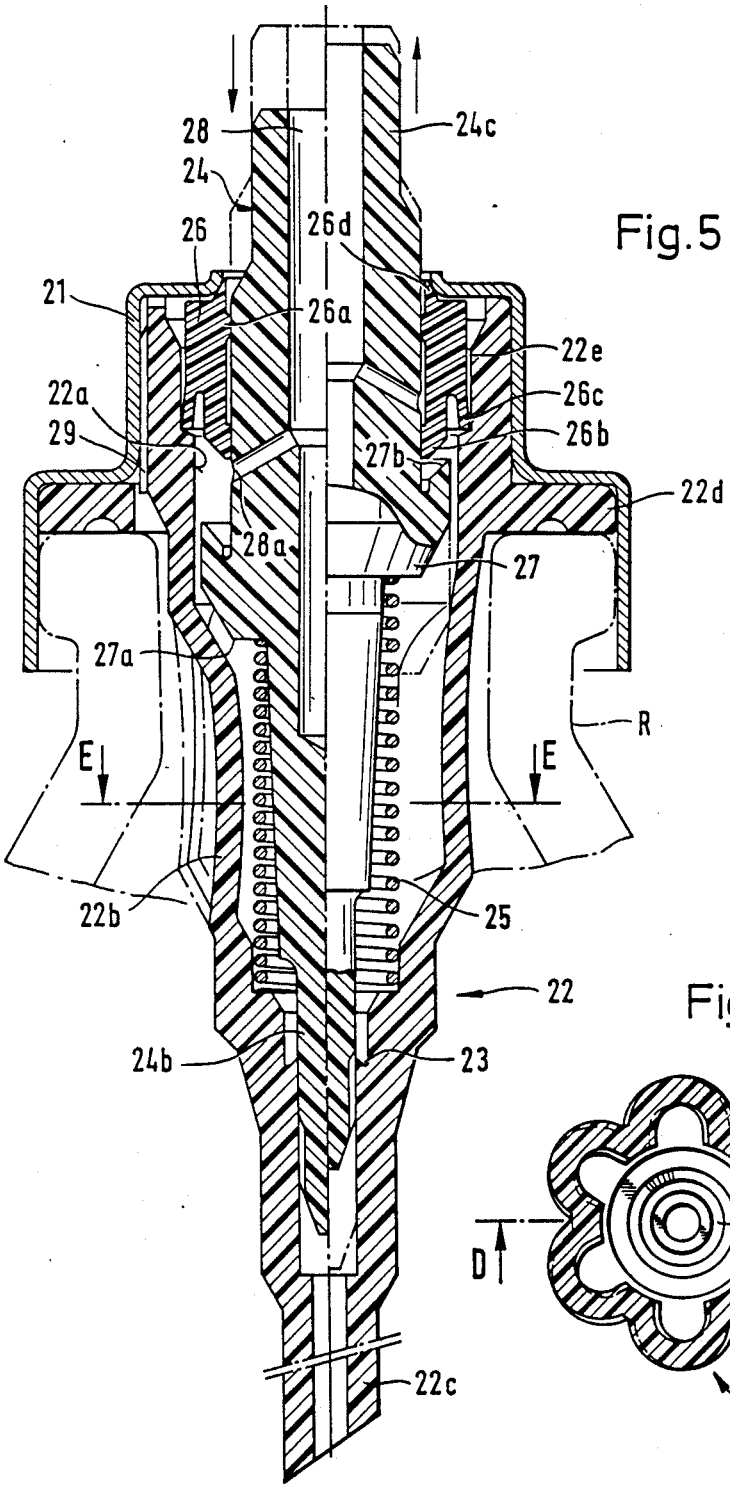
Fig.5
Fig.6
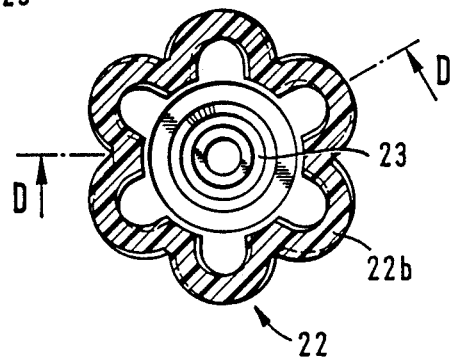

PRECOMPRESSION PUMP

CROSS-REFERENCE TO RELATED APPLICATION

This application claims benefit of French patent application No. FR 8800852 filed Jan. 26, 1988 on behalf of Societe Francaise d'Aerosols et de Bouchage.

BACKGROUND OF THE INVENTION

The majority of miniaturized pumps used on devices such as atomizers for perfume, insecticides and medicines are precompression pumps wherein upon depression the opening of the discharge orifice is delayed due to the relative positioning of the piston, the discharge orifice or evacuation duct and the pump chamber or due to a mechanical resistance. In such a pump, the depression of the piston initially causes an accumulation of pressure or energy in the pump chamber which results in a clear cut and even spraying of the pump chamber contents upon establishing communication between the pump chamber and the discharge orifice. The pressure or energy accumulation in the pump chamber occurs during the first part of the plunging stroke of the piston by means of compression of air or of an auxiliary elastic-return element, and in the second part of the plunging stroke of the piston or when the piston has reached its low point the accumulated pressure or energy causes the even and clear cut spraying of the pump chamber contents.

One of the simplest examples of this type of pump may be referred to in U.S. Pat. No. 3,194,447. In these types of pumps there are very few moving elements, and the piston acts as a slide valve inside the pump body and blocks or unblocks the discharge orifice at mid-stroke. At the beginning of an upward motion under the effect of its return spring, the piston causes air to be drawn into the pump chamber through the discharge orifice. When the piston is forced to descend, the air in the pump chamber is first compressed, and then, upon establishing communication between the pump chamber and the discharge orifice, the compressed air will cause material in the pump chamber to be entrained therein and atomized through the discharge orifice.

SUMMARY OF THE INVENTION

The present invention relates to precompression pumps, as described above, which are very effective despite their simple structure, and wherein the precompression results essentially from the radial deformation of a portion of the pump body possibly accompanied by some compression of air inside the pump body. To effect this purpose, the portion of the body designed to radially deform has at least a portion of one side wall of noncircular cross-section. When radially deformed and particularly when radially bent outward, the noncircular portion of the side wall, which is made of a somewhat elastically deformable material, will exert a counterforce upon the contents of the pump chamber and when the discharge orifice is put in communication with the pump chamber, will cause the discharge of pump chamber contents while regaining its initial configuration.

The present invention relates to a pump comprising an open-ended hollow body defining a pump chamber and an inlet orifice which communicates with a reservoir, a piston mounted for reciprocal movement through a portion of the body and extending through the upper end of the body, a ferrule defining an aperture through which the piston extends, a seal disposed between the ferrule and a portion of the body and surrounding a portion of the piston, and a spring mounted in the body which actively biases the piston toward the top of the body, the body having a deformable zone which has at least a portion of one side wall which is of noncircular cross-section and which has a portion which is radially elastically deformable, the piston having an evacuation duct which puts the pump chamber in communication with ambient air when the piston is sufficiently depressed, and the evacuation duct and the piston being configured and dimensioned so as to delay the placing of the pump chamber into communication with ambient air until after the piston is depressed into the body sufficiently to pressurize the pump chamber and radially elastically deform the deformable zone.

The intake orifice, through which the container contents pass when flowing from the container reservoir to the pump chamber, is also preferably opened and closed by means of a slide valve in order to improve the accuracy of operation of the precompression pump. The closing of the intake orifice occurs upon the depression of the piston prior to the pump chamber being put into communication with ambient air by the evacuation duct.

An embodiment of a pump according to the present invention can have the piston provided with an elongated portion which is of such length that it blocks the intake orifice when the piston is slightly depressed, and the elongated portion of the piston and the evacuation duct are each configured and dimensioned so that when the piston is depressed the blocking of the intake orifice by the elongated portion is effected prior to the placing of the pump chamber into communication with ambient air through the evacuation duct.

The pump bodies according to the present invention can be mostly made up of a number of segments which are substantially cylindrical and are easily molded and the mold easily machined. The narrowest cylindrical segment of the pump body corresponds to the area of the intake orifice, a slightly widened substantially cylindrical segment forms a well for a return spring and a wider substantially cylindrical segment forms the pump chamber wherein the piston reciprocally moves. At least a portion of one of the side walls of one of the segments is of noncircular cross-section and forms the deformable zone.

According to the present invention, the deformable zone of the pump body will preferably have segments of the side wall with rectilinear generatrices, thus maintaining an approximately cylindrical or a slightly conical shape. It can be of elliptical cross-section, however, preferably the cross-section is polygonal, such as an equilateral triangle, a square, star-shaped, trefoil or multifoil when the pump is idle. It is connected by two stepping zones to two circular segments, the segment of the intake orifice and threshold and the segment which houses the discharge threshold, the vent and corresponding seals on which the piston slides. The deformable zone could be of helical structure, however, in such embodiments it is not desirable that the radial deformation be able to be accompanied by a significant lengthening of the deformable zone.

According to the present invention, an embodiment of a pump can have a deformable zone having at least one side wall that is substantially planar when said pump is idle, or having a portion of at least one side wall which, when the pump is idle, is of polygonal cross-section, is of star-shaped cross-section, is of trefoil cross-section, is of multifoil cross-section, has segments with rectilinear generatrices, or has a portion which is hyperbolic in shape when said pump is idle, or any combination thereof. Further, the deformable zone can have each side wall of non-circular cross-section having a radially elastically deformable portion.

The side walls of the deformable zone can squeeze against the piston when the pump is idle. Also, the pump chamber can have an upper portion which is of circular cross-section, and be radially elastically deformable over substantially its entire length and have a slight longitudinal elasticity.

There are a number of synthetic materials available for the deformable zone, in particular elastomers of polyesters or even polyethylenes, which possess both the desired stiffness and a limited but sufficient degree of elasticity which prevents any permanent deformation.

A pump according to the present invention can have the seal provided with at least one vent which places the reservoir in communication with ambient air when the piston is not at its high point, the seal being disposed between the ferrule and the body with slight play in a seal space defined in the upper part of the body such that the seal is substantially surrounded by a portion of the body, the seal possessing at least three active bearing surfaces: a first bearing surface in the form of a lower lip configured and dimensioned to abut a portion of the piston when the piston is at its high point, a second bearing surface in the form of a lip configured and dimensioned so as to abut a portion of the body in the bottom of the seal space when the piston is at its low point, and a third bearing surface configured and dimensioned so as to be tightly fitted between the ferrule and the piston when the piston is at its high point. The first bearing surface and the third bearing surface can be oblique. Also, the seal can have a height greater that the reciprocal movement of the piston and the evacuation duct can be blocked by the seal when the pump is idle.

BRIEF DESCRIPTION OF THE DRAWINGS

FIG. 1 is a longitudinal cross-section of a pump according to the present invention.

FIG. 2A is a cross-section taken along line A—A of FIG. 1.

FIG. 2B is a cross-section taken along line B—B of FIG. 1.

FIG. 3 is a longitudinal cross-section of a pump according to the present invention.

FIG. 4 is a cross-section taken along line C—C of FIG. 3.

FIG. 5 is a broken longitudinal cross-section of a pump according to the present invention taken along line D—D of FIG. 6 and showing two longitudinal half-sections of a pump wherein the left section shows the discharge orifice unblocked and the right section shows the pump idle.

FIG. 6 is a cross-section taken across line E—E of FIG. 5.

DETAILED DESCRIPTION OF THE PREFERRED EMBODIMENT

In the description which follows, any reference to either size, length, orientation or direction is intended primarily for the purpose of illustration and is not intended in any way as a limitation of the scope of the present invention.

As shown in FIG. 1, the pump according to the present invention is intended to be fastened to an appropriate container R by ferrule 1. The pump includes body 2 which has a chamber which is cylindrical and of circular cross-section in upper part 2*a*, a narrower deformable well 2*b* which is of square cross-section and is radially deformable, and an end 2*c* which is of circular cross-section and includes intake threshold 3 and receives a connection tube leading from the container reservoir.

A piston 4 is provided for reciprocal movement in pump body 2. The piston 4 has piston head 4*a*, which reciprocally slides in upper pump chamber 2*a*, pin 4*b* which extends through deformable well 2*b* and serves as a sealing slide valve and guide on threshold 3, piston rod 4*c* which has discharge orifice or evacuation duct 8 which serves as an atomizer and receives a control plunger, and piston head 4*a* defines air pocket 4*d* between the side walls of piston head 4*a* and the outer surface of pin 4*b*. Piston 4 is actively biased to return towards the top of pump chamber 2*a* by spring 5 which surrounds pin 4*b* and extends from the top of air pocket 4*d* to threshold 3.

Piston head 4*a* slides on seal 6 having main lips, upper lip 6*a* and lower lip 6*b*. Piston head 4*a* is provided with flange 7 which abuts lower lip 6*b* to prevent further upward motion of piston 4. Flange 7 has several notches 7*a* on its lower face.

Seal 6 has a number of ducts or vents 9 which pass between main lips 6*a* and 6*b* to communicate with the interior of the container and serve as a vent for it. Seal 6 is preferably made of two pieces.

When piston 4 is depressed, the intake orifice at threshold 3 is almost immediately closed, and then the fluid inside of pump body 2 is compressed and the side walls of deformable well 2*b* are radially deformed, as shown by arrows in FIG. 2*b*. As the piston 4 is further lowered, openings 8*a* of evacuation duct 8 pass upper lip 6*a*, and the inside of the container is put in communication with ambient air through vents 9 and evacuation duct 8. The fluid inside pump body 2 is further compressed as the piston lowers until openings 8*a* pass lower lip 6*b*, whereupon the pump body contents discharge through evacuation duct 8. Notches 7*a* maintain communication between air pocket 4*d*, deformable well 2*b* and evacuation duct 8, even as piston head 4*a* strikes the bottom of pump chamber 2*a*.

Successively, therefore, the container is put at atmospheric pressure, then the contents of the pump are driven outside by the return of the walls of deformable well 2*b* to their initial shape. During the operation, the compression then the expansion of the confined air along the upper coils of spring 5 complete the precompression effect provided by the deformable zone of pump body 2.

When the operator releases the piston, then allowing the piston to rise under the force of the spring, the effect of the vacuum thus created in the pump sucks, upon the opening of the intake orifice at threshold 3, a new quantity of material.

It also can be seen that after being put on discharge, the descending travel of the piston continues before it strikes the bottom of upper pump chamber 2*a*. Consequently, on the return of the piston the pump is able to first suck a little ambient air, which renews pocket 4*d*.

The embodiment of the present invention illustrated in FIGS. 3 and 4 is shown mounted on a container and with its piston plunged in, i.e., in spraying position. The pump's structure is rather similar to the structure of the above-described embodiment, and its various elements are designated with numerals 11 through 18, which numerals correspond to the reference number used for the equivalent part in FIG. 1 plus 10. The design of the pump of FIGS. 3 and 4 does, however, deviate from the above embodiment in several respects.

In the first place, the pump is a flanged pump, i.e., upper part 12*a* of body 12 forms a wide edge 12*d*, simply held at its outer edges by notches in a flat ferrule 11.

The elasticity of the pump body material makes this edge 12*d* able to serve as a seal for the container. Seal 16 on which the head of the piston slides and which forms the discharge threshold is cast in one piece and has no vents; it various lips therefore assure only the sealing of the pump.

Pump body 12 has a chamber which is of circular cross-section, both in end 12*c* which includes intake threshold 13, and in upper area 12*a* which serves as a seat for seal 16. Main pump chamber portion 12*b* is cylindrical but for most of its length it is trefoil in shape, while connected to said segments through two conical sections, as shown in FIG. 4, and when the piston is in its idle position, the trefoil portion squeezes against piston head flange 17 and exerts a slight pressure thereon. The trefoil portion of main pump chamber 12*b* is radially deformable, as shown in FIGS. 3 and 4 and has side walls which, when viewed in cross-section, are thinner in the narrower portions than in the broader portions.

Due to the upper configuration of the trefoil shaped main pump chamber 12*b*, the lower face of flange 17 does not need to be notched, Spring 15 is provided with appropriately contiguous coils which prevent piston 14 from striking body 12.

In operation, as piston 14 is lowered, successively the intake orifice is closed, the fluid inside the pump chamber is compressed and the side walls of the trefoil portion of main pump chamber are radially deformed, the pump is put on discharge to expel contents of the pump chamber by means of the accumulated pressure and the return of the deformed trefoil walls to their initial configuration followed by the inner trefoil walls coming into contact with flange 17, which ends the spraying.

But as a result of the absence of vents, each use causes the pressure in the container to lower, so that for the rise of the piston under the force of the spring to suck a new quantity of liquid into the pump chamber until complete exhaustion of the product, it is necessary that it be able to create a considerable vacuum. This requires that the piston strike low as soon as the discharge orifice of evacuation duct 18 is unblocked so that the quantity of ambient air resucked during the upward return of piston 14 is negligible, in contrast with what happened in the preceding embodiment. Body 12 further possesses a slight longitudinal elasticity. Consequently, the force of the user causes a very slight lengthening and its release is accompanied by the reverse shortening, which again reduces the resuction.

The variant of FIGS. 5 and 6 is very comparable with that of FIGS. 3 and 4 and the references of its various elements, 21 through 28, are again equivalent. FIG. 6 shows that the cross section of lower part 22*b* of the pump body is this time substantially star-shaped, and more precisely hexafoil. In addition, a slight obliqueness of its ribs gives to its longitudinal section, that can be seen in FIG. 5, a slightly hyperbolic shape with a slight undercut. This increases the liveliness of the wall of this body, which here consists of polyethylene.

FIG. 5 comprises two half-sections, shown in an intermediate positions: (1) at the left, at the end of compression, at the moment discharge orifice 28*a* is unblocked, and (2) at the right, at the end of the rise of piston 24, i.e., at the beginning of suction of a new amount of liquid. It can be noted that the connection tube here is an integral part of low part 22*c* of the body.

Another remarkable characteristic resides in the structure of outer seal 26. Seal 26 no longer takes on a flat shape but that of a thin bushing, with a height greater that the travel of the piston, which makes it possible to keep discharge orifice 28*a* blocked on the outside when the pump is idle to prevent any oozing. Seal 26 is held, with a slight play between body 22 and ferrule 21, in a clearance 22*e* made at the upper part 22*a* of the chamber, located above plate 22*d*, such that seal 26 is substantially surrounded by body 22. Notches 29 pass through body 22 to clearance 22*e* to serve as vents when piston 24 is not at its high point.

Seal 26 has four active bearing surfaces. The first two are inside and piston 24 slides thereon: One, 26*a*, in the form of a guide ring on the atomizer above orifice 28*a*, could admittedly be omitted; the other 26*b*, in the form of a lower lip, also serves as a high stop for the piston on upper flange 27*b* of its collar 27. Lower bearing surface 27*a* of flange 27 abuts body 22 at the low point of piston 24. The other two bearing surfaces of seal 26 face away from piston 24: bearing surface 26*c* in the form of a lip in clearance 22*a* is an additional sealing of the pump chamber when the piston 24 is at its low point, and bearing surface 26*d* seals between ferrule 21 and piston 24 when the piston is at its high point. The three stopping seals or bearing surfaces 26*b*,*c* and *d*, are oblique. Bearing surface 26*d* seals between piston 24 and ferrule 21 while bearing surface 26*b* seals between flange collar 27*b* and pump body 22, and together they provide a tight seal between the pump chamber and ambient air when piston 25 is idle and maintained at its high point by spring 25. This prevents escape of container contents when the pump is idle. When piston 24 is at its high point, bearing surface 26*b* and bearing surface 26*d* are antagonistic and seal 26 is squeezed between flange collar 27*b* and ferrule 21.

As soon as piston 24 is depressed, seal 26 is released with bearing surface 26*d* losing its seal and allowing ambient air to establish atmospheric pressure in the container. The operational sequence of this embodiment is similar to the above-described embodiments: compression and deformation: discharge, expansion and expelling then resuction and finally drawing in a new amount of material. The design of the seal of the present embodiment assures the desired sealing in all circumstances.

The present invention is in no way limited by the above-described preferred embodiments, rather the scope of invention is defined by the claims which follow.

We claim:

1. A pump comprising an open-ended hollow body defining a pump chamber and an inlet orifice which communicate with a reservoir, a piston mounted for reciprocal movement through a portion of said body and extending through the upper end of said body, a ferrule disposed above said body and defining an aperture through which said piston extends, a seal disposed between said ferrule and a portion of said body and surrounding a portion of said piston, and a spring mounted in said body which actively biases said piston toward the aperture, said body having a deformable zone which when said pump is idle has at least a portion having a horizontal cross-sectional shape chosen from the group consisting of polygonal, star-shaped, trefoil and multifoil, said deformable zone being radially elastically deformable, said deformable zone defining at least a part of the pump chamber, said piston having a portion which blocks said inlet orifice when said piston is depressed a first predetermined distance, said piston having an evacuation duct having a lower duct portion extending through the periphery of said piston which puts said pump chamber in communication with ambient air when said piston is depressed a second predetermined distance sufficient for said lower duct portion to be lower than the bottom of said seal, said second predetermined distance being greater than said first predetermined distance, said lower duct portion being located sufficiently high on said piston so as to delay the placing of said pump chamber into communication with ambient air by said evacuation duct until after said piston is depressed into said body said second predetermined distance which is sufficiently in excess of said first predetermined distance so as to pressurize said pump chamber and radially elastically deform said deformable zone; said pump chamber having an upper portion which is of circular cross-section; said pump chamber being radially elastically deformable over substantially its entire length; and said body having a slight longitudinal elasticity.

2. A pump according to claim 1 wherein said portion of said piston which blocks said inlet orifice when said piston is depressed said first predetermined distance comprises an elongated portion which extends down into said pump chamber, the bottom of said elongated portion being positioned adjacent said inlet orifice when the pump is idle so that said first predetermined distance is a small distance.

3. A pump according to claim 1 wherein said seal is provided with at least one vent which places the reservoir in communication with ambient air through said evacuation duct when said piston is depressed a third predetermined distance which is less than or equal to said second predetermined distance.

4. A pump according to claim 1 wherein said deformable zone is made of a polyester elastomer.

5. A pump according to claim 1 wherein said deformable zone is made of polyethylene.

6. A pump comprising an open-ended hollow body defining a pump chamber and an inlet orifice which communicates with a reservoir, a piston mounted for reciprocal movement through a portion of said body and extending through the upper end of said body, a ferrule disposed above said body and defining an aperture through which said piston extends, a seal disposed between said ferrule and a portion of said body and surrounding a portion of said piston, and a spring mounted in said body which actively biases said piston toward the aperture, said body having a deformable zone which when said pump is idle has at least a portion having a horizontal cross-sectional shape chosen from the group consisting of polygonal, star-shaped, trefoil, multifoil, a shape having a portion of one side wall which is of noncircular cross-section and a shape having at least one side wall that is substantially planar, said deformable zone being radially elastically deformable, said deformable zone defining at least a part of the pump chamber, said piston having a portion which blocks said inlet orifice when said piston is depressed a first predetermined distance, said piston having an evacuation duct having a lower duct portion extending through the periphery of said piston which puts said pump chamber in communication with ambient air when said piston is depressed a second predetermined distance sufficient for said lower duct portion to be lower than the bottom of said seal, said second predetermined distance being greater than said first predetermined distance, said lower duct portion being located sufficiently high on said piston so as to delay the placing of said pump chamber into communication with ambient air by said evacuation duct until after said piston is depressed into said body said second predetermined distance which is sufficiently in excess of said first predetermined distance so as to pressurize said pump chamber and radially elastically deform said deformable zone; said piston having a portion which is disposed within said deformable zone when the pump is idle and wherein portions of the side walls of said deformable zone are squeezed against said piston when said pump is idle.

7. A pump according to claim 6 wherein said portion o said piston which blocks said inlet orifice when said piston is depressed said first pre-determined distance comprises an elongated portion which extends down into said pump chamber, the bottom of said elongated portion being positioned adjacent said inlet orifice when the pump is idle so that said first predetermined distance is a small distance.

8. A pump according to claim 6 wherein said seal is provided with at least one vent which places the reservoir in communication with ambient air through said evacuation duct when said piston is depressed a third predetermined distance which is less than or equal to said second predetermined distance.

9. A pump according to claim 6 wherein the pump chamber has an upper portion which is of circular cross-section.

10. A pump according to claim 6 wherein the pump chamber has a hyperbolic shape with rectilinear generatrices in vertical cross-section and said pump chamber is radially elastically deformable over substantially its entire length.

11. A pump according to claim 6 wherein the body has a slight longitudinally elasticity.

12. A pump comprising an open-ended hollow body defining a pump chamber and an inlet orifice which communicates with a reservoir, a piston mounted for reciprocal movement through a portion of said body and extending through the upper end of said body, a ferrule disposed above said body and defining an aperture through which said piston extends, a seal disposed between said ferrule and a portion of said body and surrounding a portion of said piston, and a spring mounted in said body which actively biases said piston toward said aperture, said body having a deformable zone which has at least a portion of one side wall which is of noncircular horizontal cross-section, said deformable zone being radially elastically deformable, said piston having a portion which blocks said inlet orifice when said piston is depressed a first predetermined distance, said piston having an evacuation duct having a lower duct portion extending through the periphery of said piston which puts said pump chamber in communication with ambient air when said piston is depressed a second predetermined distance sufficient for said lower duct portion to be lower than said seal, said second predetermined distance being greater than said first predetermined distance, said lower duct portion being located sufficiently high on said piston so as to delay the placing of said pump chamber into communication with ambient air by said evacuation duct until after said piston is depressed into said body said second predetermined distance which is sufficiently in excess of said first predetermined distance so as to pressurize said pump chamber and radially elastically deform said deformable zone, wherein said seal is disposed between said ferrule and said body with slight play in the vertical direction in a seal space defined by the upper part of said body such that said seal is substantially surrounded by a portion of said body, said body being provided with a vent which places the reservoir in communication with ambient air when said piston is depressed a third predetermined distance which is less than or equal to said second predetermined distance, said seal possessing at least three active bearing surfaces; a first bearing surface in the form of an inner lower lip disposed adjacent said piston so as to abut a portion of said piston when said piston is at its high point, a second bearing surface in the form of an outer lower lip disposed adjacent said body in the lower portion of said seal space so as to abut a portion of said body which defines the bottom of said seal space when said piston is at its low point, and a third bearing surface in the form of an inner upper lip disposed adjacent the ferrule, the aperture and the piston so as to be tightly fitted between said ferrule and said piston when said piston is at its high point with said piston in conjunction with said spring biasing said seal toward said aperture and said seal being sufficiently undersized in the vertical dimension so as to allow communication between said reservoir and ambient air through said vent when said piston is depressed said third predetermined distance so that said third bearing surface is not tightly fitted between said ferrule and said piston.

13. A pump according to claim 12 wherein said first bearing surface and said third bearing surface are oblique.

14. A pump according to claim 12 wherein said seal has a height greater that the reciprocal movement of said piston and said lower duct portion is blocked by said seal when said pump is idle.

15. A pump comprising an open-ended hollow body defining a pump chamber and an inlet orifice which communicates with a reservoir, a piston mounted for reciprocal motion through a portion of said body and extending through the upper end of said body, a ferrule disposed above said body and defining an aperture through which said piston extends, and a spring mounted in said body which actively biases said piston toward said aperture, a seal disposed between said ferrule and said body with slight play in the vertical direction in a seal space defined by the upper part of said body such that said seal is substantially surrounded by a portion of said body and said seal surrounds a portion of said piston, said piston having an evacuation duct having a lower duct portion extending through the periphery of said piston which puts said pump chamber in communication with ambient air when said piston is depressed a first predetermined distance sufficient for said lower duct portion to be lower than the bottom of said seal, said body being provided with a vent which places the reservoir in communication with ambient air when said piston is depressed a second predetermined distance which is less than or equal to said first predetermined distance, said seal possessing at least three active bearing surfaces: a first active bearing surface in the form of an inner lower lip disposed adjacent said piston so as to abut a portion of said piston when said piston is idle, a second bearing surface in the form of an outer lower lip disposed adjacent said body in the lower portion of said seal space so as to abut a portion of said body which defines the bottom of said seal space when said piston is at its low point, and a third bearing surface in the form of an inner upper lip disposed adjacent the ferrule, the aperture and the piston so as to be tightly fitted between said ferrule and said piston when said piston is at its high point with said piston in conjunction with said spring biasing said seal toward said aperture and said seal being sufficiently undersized in the vertical dimension so as to allow communication between said reservoir and ambient air through said vent when said piston is depressed said second predetermined distance so that said third bearing surface is not tightly fitted between said ferrule and said piston.

16. A pump according to claim 15 wherein said first bearing surface and said third bearing surface are oblique.

17. A pump according to claim 15 wherein said seal has a height greater than the reciprocal movement of said piston and said lower duct portion is blocked by said seal when said pump is idle.

18. A pump comprising an open-ended hollow body defining a pump chamber and an inlet orifice which communicates with a reservoir, a piston mounted for reciprocal motion through a portion of said body and extending through the upper end of said body, a ferrule disposed above said body and defining an aperture through which said piston extends, a spring mounted in said body which actively biases said piston toward said aperture, a seal disposed between said ferrule and said body with slight play in the vertical direction in a seal space defined by the upper part of said body such that said seal is substantially surrounded by a portion of said body and said seal surrounds a portion of said piston, said body having a deformable zone which is radially elastically deformable, said deformable zone defining at least a part of the pump chamber, said piston having a portion which blocks said inlet orifice when said piston is depressed a first predetermined distance, said piston having an evacuation duct having a lower duct portion extending through the periphery of said piston which puts said pump chamber in communication with ambient air when said piston is depressed a second predetermined distance sufficient for said lower duct portion to be lower than the bottom of said seal, said second predetermined distance being greater than said first predetermined distance, said lower duct portion being located sufficiently high on said piston so as to delay the placing of said pump chamber into communication with ambient air by said evacuation duct until after said piston is depressed into said body said second predetermined distance which is sufficiently in excess of said first predetermined distance so as to pressurize said pump chamber and radially elastically deform said deformable zone, said body being provided with a vent which places the reservoir in communication with ambient air when said piston is depressed a third predetermined distance which is less than or equal to said second predetermined distance, said seal possessing at least three active bearing surfaces: a first active bearing surface in the form of an inner lower lip disposed adjacent said piston so as to abut a portion of said piston when said piston is idle, a second bearing surface in the form of an outer lower lip disposed adjacent said body in the lower portion of said seal space so as to abut a portion of said body which defines the bottom of said seal space when said piston is at its low point, and a third bearing surface in the form of an inner upper lip disposed adjacent the ferrule, the aperture and the piston so as to be tightly fitted between said ferrule and said piston when said piston is at its high point with said piston in conjunction with said spring biasing said seal toward said aperture and said seal being sufficiently undersized in the vertical dimension so as to allow communication between said reservoir and ambient air through said vent when said piston is depressed a third predetermined distance so that said third bearing surface is not tightly fitted between said ferrule and said piston.

19. A pump according to claim 18 wherein said first bearing surface and said third bearing surface are oblique.

20. A pump according to claim 18 wherein said seal has a height greater than the reciprocal movement of said piston and said lower duct portion is blocked by said seal when said pump is idle.

* * * * *

UNITED STATES PATENT AND TRADEMARK OFFICE

CERTIFICATE OF CORRECTION

PATENT NO. : 4,936,492

DATED : June 26, 1990

INVENTOR(S) : Amiel et al.

It is certified that error appears in the above-identified patent and that said Letters Patent is hereby corrected as shown below:

Claim 1, Col. 7, lines 31-32, delete "substantially its entire length" and insert -- the main part of its -- therefor.

Claim 7, col. 8, line 26, delete "o said piston" and insert -- of said piston -- therefor.

Claim 7, col. 8, lines 43-44, delete "with rectilinear generatrices".

Claim 15, col. 9, line 54, delete "and".

Signed and Sealed this

Twenty-fourth Day of September, 1991

*Attest:*

HARRY F. MANBECK, JR.

*Attesting Officer*

*Commissioner of Patents and Trademarks*